United States Patent [19]

Baswell

[11] 4,431,181

[45] Feb. 14, 1984

[54] COLLAPSIBLE GYM APPARATUS

[76] Inventor: Steven E. Baswell, Rte. 1, Box 392, Ohatchee, Ala. 36271

[21] Appl. No.: 274,889

[22] Filed: Jun. 18, 1981

[51] Int. Cl.[3] ..... A63B 1/00; A63B 21/06

[52] U.S. Cl. ..... 272/62; 272/134; 272/DIG. 4; 272/118

[58] Field of Search ..... 272/93, 62, 118, 130, 272/134, 136, 143, 144, 145, DIG. 4

[56] References Cited

U.S. PATENT DOCUMENTS

| | | | |
|---|---|---|---|
| 309,678 | 12/1884 | Aubin | 272/144 |
| 332,989 | 12/1885 | Benedict . | |
| 382,440 | 5/1888 | Sanchez . | |
| 2,219,219 | 10/1940 | Boger . | |
| 2,632,645 | 3/1953 | Barkschat | 272/62 |
| 3,218,070 | 11/1965 | Crowther . | |
| 3,226,115 | 12/1965 | Underhill . | |
| 3,438,627 | 4/1969 | La Lanne . | |
| 3,501,140 | 3/1970 | Eichorn . | |
| 3,734,494 | 5/1973 | Sellner | 272/62 X |
| 3,874,657 | 4/1975 | Niebojewski . | |
| 4,136,868 | 1/1979 | Hogue . | |
| 4,300,761 | 11/1981 | Howard | 272/134 |

*Primary Examiner*—Richard J. Apley
*Assistant Examiner*—William R. Browne
*Attorney, Agent, or Firm*—Lowe, King, Price & Becker

[57] ABSTRACT

A collapsible gym apparatus includes first and second pairs of support legs having upper ends pivotally secured to a transverse pivot shaft to define an A-frame support structure in set-up position. The first pair of support legs is pivotally secured at lower ends to a storage cabinet that receives the support legs in substantially flat, vertical, fold-up position. Exercising attachments, including a bench press bar, dip bars, adjustable weights, a chinning bar and the like, are provided on the first and second pairs of legs. The exercising attachments is capable of easy and rapid pivoting movement into substantially flat, fold-up position on the legs for upright storage with the support legs in the cabinet.

24 Claims, 5 Drawing Figures

94
92
90
75
E
84
20
14
71
70
72
16
65
59
63
108
100
102
106
104
26
32
57
58
51
40'
35
53
B
49
45
A
D
25'
27'
43b
43a
40
41b
37
41
41a

COLLAPSIBLE GYM APPARATUS

FIELD OF THE INVENTION

The present invention relates generally to exercising apparatus and, more particularly, to a collapsible gym apparatus having an A-frame support structure carrying exercising attachment means which is capable of assuming a set-up position upon a floor or the like and thereafter fold up into substantially flat storage position.

BACKGROUND ART

A variety of portable physical fitness-type apparatus are known to enable user performance of various exercises in the home or office. Certain types of these exercising apparatus are provided as fixed structures useful for performing a variety of exercises; however, they are incapable of folding up so as to occupy less space after exercise completion. Such devices are difficult to use in the home or office, where living or working space is also required for other purposes.

While collapsible gym apparatus are known for folding to storage positions against a wall or the like, to my knowledge, such apparatus are generally beset with several problems. For example, due to their collapsible nature, certain of these devices lack the structural rigidity necessary for performing certain exercises imparting full body weight to the structure, such as chin-ups, dips, and the like.

Other collapsible gym devices are capable of supporting full body weight and tend to expand the number of exercises capable of performance on them. For example, in U.S. Pat. No. 3,501,140 to Eichorn, there is disclosed a collapsible gym apparatus having four vertical, corner mounting posts defining a rectangular shaped gymnasium. The gymnasium includes an overhead horizontal ladder, inclined bench and weight/cable arrangement for weight pulling exercises. The mounting posts are hingedly secured to floor bracing, and are buttressed with a number of hinged, diagonal bracing members to support body weight and maintain the structure in stable, set-up position.

While numerous exercises can be performed on such devices, a large surface area is required for exercising use. In smaller rooms, these devices can preclude other activities from simultaneously occuring. In addition, such devices can require substantial amounts of time to set up, or fold up after use, and can be inconvenient to use during office hours.

Other collapsible devices are capable of supporting full body weight but require attachment to a wall or other load supporting structure, and also require storage space for the weight bench and other accessories.

SUMMARY OF THE INVENTION

It is accordingly an object of the present invention to provide a new and improved collapsible gym apparatus capable of allowing performance of a wide variety of exercises.

Another object of the invention is to provide an A-frame supporting structure capable of pivoting into set-up position on a floor or the like, and thereafter fold up into substantially flat storage position when the exercises are completed.

A further object is to provide exercising attachment means on the supporting structure which are capable of easy pivoting movement into set-up position, and which thereafter fold up into substantially flat storage position against the support structure.

Still another object of the present invention is to provide a collapsible gym apparatus capable of fast and reliable set-up positioning and fold-up storage positioning.

Yet another object is to provide a collapsible gym apparatus which occupies a small amount of space when in set-up position.

In satisfaction of the foregoing objects and advantages, there is provided by the present invention a collapsible gym apparatus which comprises first and second pairs of parallel support legs capable of pivoting into set-up position to form a structurally rigid A-frame type support structure. The first and second pairs of legs are pivotally secured at upper portions for selective movement between a substantially flat, stored fold-up position and a set-up position. Exercising attachment means pivotally connected to the legs is also capable of selective movement between set-up position and substantially flat fold up position on the legs. Anchoring means is provided for securing the legs in stationary and fixed set-up position.

A pivot shaft interconnects the upper ends of the parallel, first support legs; the parallel second support legs being spaced inwardly from the first support legs and including upper ends pivotally secured to the pivot shaft. The lower ends of the first support legs are attached to a support shaft rotatably secured to side body members of a storage compartment. A pair of parallel, mounting tracks pivoted downwardly from the compartment flush on a flat surface receive and fixedly secure the bottom ends of the second support legs in set-up position. The inclination of the first and second support legs is adjustable to accommodate different user height requirements.

A bench press bar assembly is provided to enable a user to lift weights located in the rear part of the storage compartment. The bench press bar includes a first section having rod members pivotally secured to the first support legs. A second section pivotally secured to the first section carriers a pair of hand grips capable of projecting outwardly from the second support legs in set-up position. A cross brace maintains the first and second sections in coplanar, rigid position during use. A cable trained around a pulley arrangement located in the storage compartment and beneath the bench press bar allows weight exercising movement by raising and lowering the bench press. The first and second sections are capable of folding into flush, overlapping relationship for fold-up into the compartment in flush position on the support legs.

Dip bar means is provided for performing dips and other arm exercises. Such means preferably includes a pair of upper and lower arms pivotally attached to the second support legs. In set-up position, the upper arm is positioned horizontally and supported by the lower arm to allow the user to engage the horizontal arms for exercising movement. Disengagement of the diatal end of the lower arm from beneath the distal end of the upper arm allows the arms to pivot into substantially flat fold-up position adjacent the second support legs.

A chin bar includes parallel connecting rods pivotally secured to the pivot shaft. A cross bar interconnecting the distal ends of the connecting rods allows a user to perform chinning exercises when the bar is pivoted into fixed, overhead position forwardly from the pivot shaft. Stop members are provided in corresponding locations on the connecting rods and second support legs for abutting engagement with each other to retain the chin bar in fixed position.

Upwardly directed U-shaped mounting brackets are provided at spaced intervals along the forward edge of the second support legs. The mounting brackets receive a support bar for positioning the bench press bar handgrips outwardly from the second support legs in set-up position. A bench assembly can also be supported in the mounting brackets on the second support legs, and includes a pair of pivotal legs for maintaining the bench in horizontal position for performing sit-up and bench press exercises.

The unique design of the collapsible gym apparatus allows the first and second support legs and exercising attachment means to pivot into substantially flat fold-up position in the forward area of the storage compartment. The rear area of the compartment houses the weight and cable assembly and is easily stored against a wall or the like. Both set-up and fold-up storage positions are rapidly achieved due to the pivotal movement of the structure and pin type joints provided by the invention.

The above and still further objects, features and advantages of the present invention will become apparent upon consideration of the following detailed description of the preferred embodiment thereof, especially when taken in conjunction with the accompanying drawing.

DESCRIPTION OF THE PREFERRED EMBODIMENT

Figure 1:
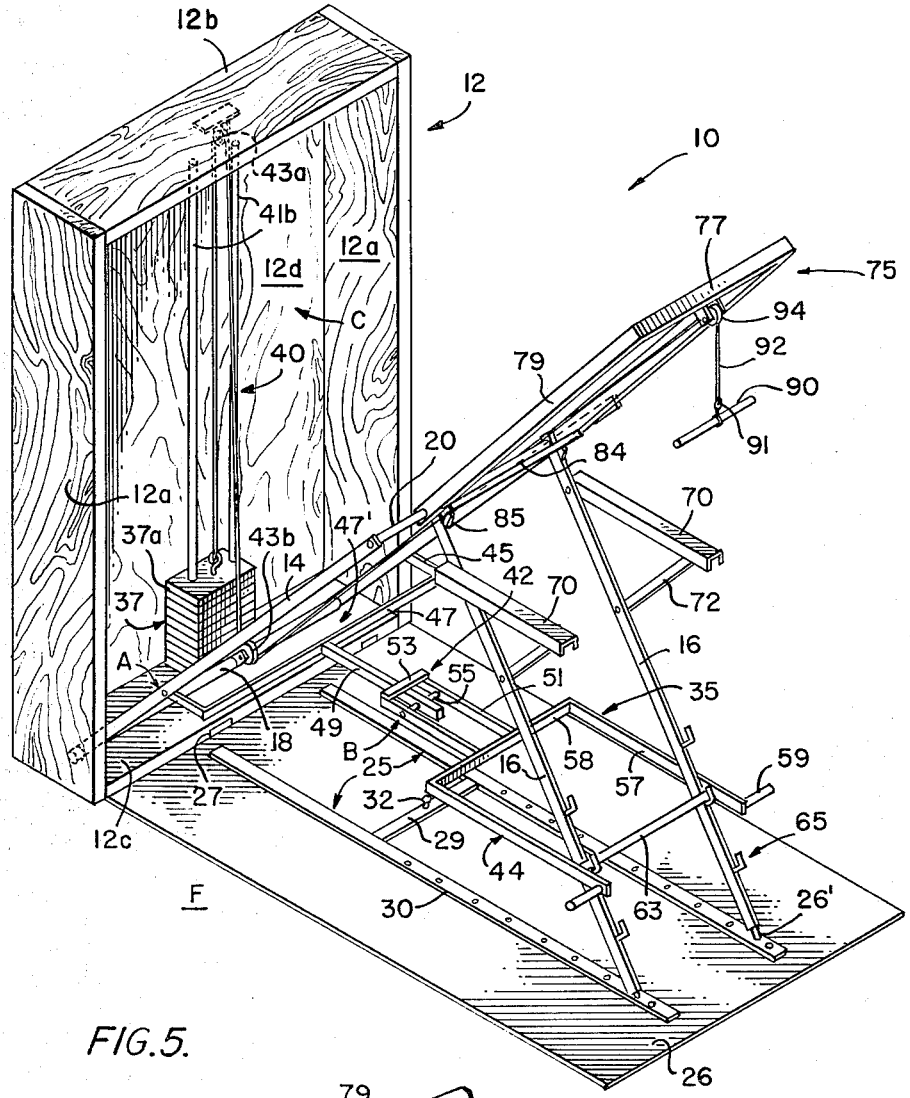
FIG. 1 is a perspective view of the collapsible gym apparatus of the present invention in set-up position.

Reference is now made to FIG. 1, wherein collapsible gym apparatus 10 is shown in set-up position upon floor F or the like, enabling performance of a wide variety of exercises at home or in the office, as hereinafter described, and thereafter fold to substantially flat storage position in cabinet housing 12. Cabinet housing 12 is constructed of lightweight materials, such as wood, and includes parallel side body members 12*a*, top and bottom panels 12*b*, 12*c*, and rear panel 12*d* which define interior compartment C housing the gym in fold-up position. The dimensions of cabinet housing 12 allow vertical positioning of the cabinet against a wall or the like when not in use. While the apparatus may be of any desired size, it can be constructed to require storage space only approximately 40 inches wide, 12 inches in depth and 66 inches in height. Wheels may be mounted outside to side body members 12*a* to allow convenient transportation of collapsible gym apparatus 10 to other locations. Collapsible gym apparatus 10 is fabricated with structurally rigid steel members or other suitable material and uses pin-type joints in the unique manner specifically set forth below.

The basic supporting structure of collapsible gym apparatus 10 comprises first and second pairs of support legs 14, 16, preferably fabricated of steel tubing. The lower ends of first support legs 14 are welded or bolted to a support shaft 18 which is rotatably secured to side body members 12*a* adjacent bottom panel 12*c*. Support shaft 18 extends transversely between the side body members approximately over the transverse center line of bottom panel 12*c* enabling the support legs to pivot into substantially vertical, fold-up position in the forward part of compartment C (FIG. 4), and also supports the legs in inclined set-up position (FIG. 1), as discussed infra.

Support legs 14 are spaced apart parallel to each other with pivot shaft 20 and sleeve member 22. Pivot shaft 20 has opposite ends journalled in the upper ends of support legs 14. Sleeve member 22 (FIG. 3), having an inner diameter substantially equal to the outer diameter of pivot shaft 20, is concentrically mounted on the pivot shaft and extends between the first support legs to space the same apart from each other, as discussed more fully below. Holes formed in the upper ends of second support legs 16 allow mounting and welded attachment thereof to sleeve member 22, to permit smooth and synchronous pivotal movement of the second support legs and rotational sleeve movement about the pivot shaft. Use of sleeve member 22 in the aforementioned manner advantageously stengthens the pivotal connections of support legs 14, 16 and the exercising accessories, as described, infra.

Figure 4:
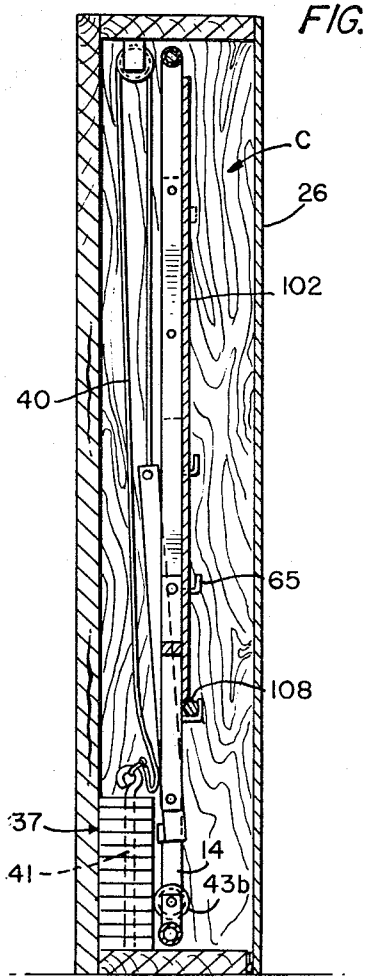
FIG. 4 is a side plan view of the collapsible gym apparatus taken through the line 4—4 in FIG. 3, showing the substantially flat positioning of the first and second support legs in the forward part of the compartment while housing the weights and cable assembly in the rear part of the compartment.

Second support legs 16 are spaced inwardly between first support legs 14 to enable both pairs of support legs to pivot into a substantially vertical, coplanar position in compartment C as shown in FIG. 4. First support legs 14 are preferably spaced apart from each other by sleeve member 22 a distance of approximately 36 inches; second support legs 16 are correspondingly spaced apart from each other on the sleeve member approximately 18 inches. Such spacing serves to accommodate a user exercising with apparatus 10 and allows for placement of other exercising features on the support legs, as discussed more fully below.

In the preferred embodiment of collapsible gym apparatus 10, door 26 is hingedly mounted to the front edge of bottom panel 12*c* with hinges 27. A pair of parallel mounting tracks 25, fabricated preferably from strips of flat stock, is affixed to the inner surface of the door in parallel relation to each other. In set-up position, door 26 is positioned on floor F exposing mounting tracks 25 in alignment with second support legs 16. A plurality of holes formed in corresponding locations along mounting tracks 25 engage pins 26' fixedly attached to the lower end of second support legs 16 to lock the second support legs in fixed, set-up position to retain the lower ends to provide a safe, stable structure (FIG. 1).

Figure 2:
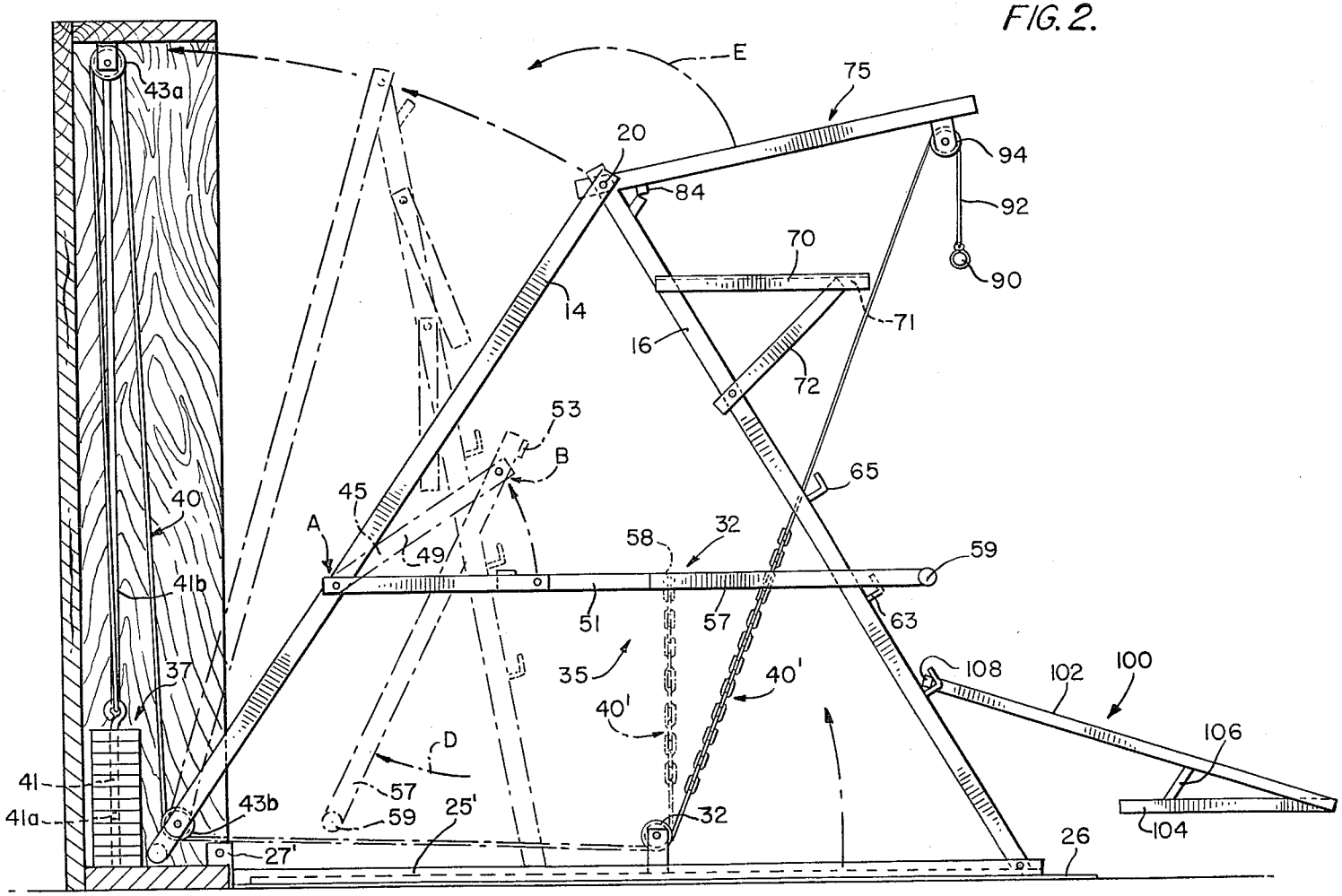
FIG. 2 is an enlarged side plan view of the collapsible gym apparatus shown in FIG. 1.

In a different embodiment, shown in FIG. 2, mounting tracks 25' are pivotally secured to the front edge of bottom panel 12*c* with hinges 27' without the use of door 26. Mounting tracks 25' are fabricated from angled members spaced apart from each other to pivot downwardly to set-up position flush on floor F and receive the lower ends of second support legs 16. A plurality of holes (FIG. 2), formed in corresponding locations in mounting tracks 25, are capable of alignment with like holes formed in the lower ends of second support legs 16. Pins inserted in the aligned holes lock the lower ends to mounting tracks 25 in set-up position and also serve to retain the lower ends to provide a safe, stable structure.

With the lower ends of second support legs 16 thusly secured, first and second pairs of support legs 14, 16 and mounting tracks 25 define a triangular, A-frame type supporting structure of collapsible gym apparatus 10, enabling performance of various body exercises, discussed infra. The feature of forming the A-frame supporting structure in the aforesaid manner advantageously allows for adjustment of height and inclination of first and second support legs 14, 16 by alignment of the lower ends of the second support legs with an appropriate pair of holes formed along mounting tracks 25 to meet individual user height requirements.

To further improve the structural rigidity of the A-frame structure, cross-member 29 extends transversely between the center sections 30 of mounting tracks 25. Cross-member 29 is fabricated from elongated, flat steel plate, and also carries pulley assembly 32 to enable operation of bench press bar assembly 35, discussed below.

Bench press bar assembly 35 is provided for enabling the user to lift weight system 37 located in the rear part of compartment C. Weight system 37 is interconnected to bench press bar 35 with pulley assembly 32 and cable means 40 (FIG. 2 only). As best shown in FIG. 1, bench press bar 35 preferably includes first and second sections 42, 44 pivotally secured together for convenient folding and storage in compartment C. First section 42 is substantially Y-shaped and includes a pair of short rod members 45 pivotally secured (pivotal joint A) to the center section of first support legs 14 for pivotal movement in a plane which is parallel to corresponding movement of the first support legs. A cross rod 47 interconnects corresponding distal ends of rods 45 in welded or bolted engagement and defines a receiving location 47' for retaining chin bar 75 in an intermediate fold-up position, as discussed more fully below. Connecting rod 49, welded to the center section of cross rod 47, projects forwardly from the cross rod in coplanar, parallel arrangement to rod members 45 for pivotal connection to second section 44.

Second section 44 includes a pair of parallel connecting rods 51, spaced apart from each other and having ends welded to cross brace 53. In set-up position, cross brace 53 transversely overlaps above connecting rod 49 and is provided for rigid coplanar alignment of the first and second sections, as discussed more fully below. Connecting rods 51 project forwardly from cross brace 53 for pivotal connection with connecting rod 49 using pin shaft 55. As shown in FIG. 1, pin shaft 55 extends through the free ends of connecting rods 49, 51 to define pivotal joint B. This connection advantageously serves to allow second section 44 to overlap against first section 42 in substantially flat fold-up position (see arrow D in FIG. 2). Second section 44 is completed with a pair of parallel rod members 57 having corresponding ends welded to cross bar 58. Cross bar 58, extending transversely and welded to the forward ends of connecting rods 51, allows the free ends of rod members 57 to project forwardly from second support legs 16 outside the second support legs, as shown in FIG. 1. Hand grips 59, welded to the free ends of rod members 57, project outwardly from second support legs 16 for gripping by the user to raise and lower bench press bar 35.

Figure 3:
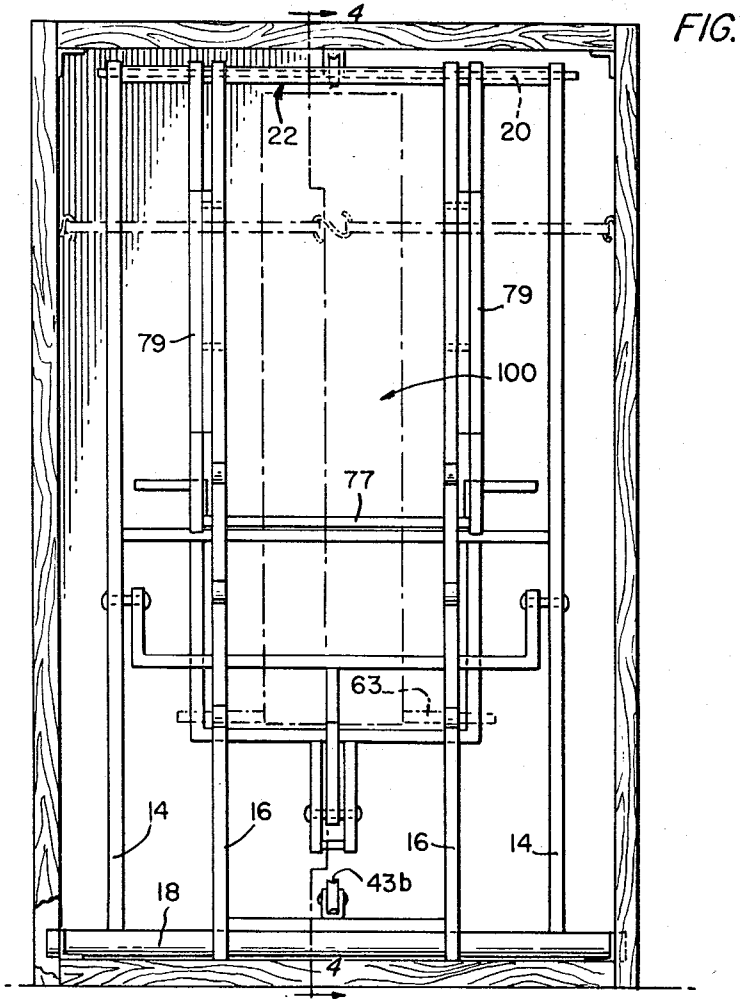
FIG. 3 is a front plan view of the collapsible gym apparatus in fold-up position within the storage cabinet.

In view of the foregoing, it can be seen that the rods and cross members defining first and second sections 42, 44 are formed coplanar with each other and include two pivotal joints A, B, as discussed above, respectively defined by rod members 45 pivotally secured to first support legs 14, and connecting rods 49, 51 pivotally securing the first and second sections together. With this design, first and second sections 42, 44 overlap each other in substantially flat, fold-up position in compartment C and can be unfolded subsequent to set-up of first and second support legs 14, 16 and mounting tracks 25. In set-up position, first and second sections 42, 44 form a flat, rigid bench press bar interlocked together by cross brace member 53. As shown in FIG. 3, cross brace 53 is fabricated of flat bar stock welded to the ends of connecting rods 51 adjacent pivotal joint B, and provides bearing contact downwardly against connecting rod 49 to maintain first and second sections 42, 44 in flat, rigid position. Unitary, pivotal movement of first and second sections 42, 44 about pivotal joint A is obtained by grasping hand grips 59 to raise and lower bench press bar 35 for lifting weights 37.

In set-up position, hand grips 59 are supported outwardly from second support legs 16 with support bar 63. Support bar 63 extends transversely between a pair of upwardly directed U-shaped brackets 65 attached to the forward edge of the second support legs in corresponding location. U-shaped brackets 65 allow horizontal mounting of support bar 63 freely positioned in the brackets. The ends of support bar 63 project outwardly from the second support legs and support the forward ends of rod members 57, thereby maintaining bench press bar means 35 in substantially horizontal position for use.

A plurality of correspondingly positioned U-shaped brackets 65, spaced apart from each other along the lower half of second support legs 16, allows for height adjustment of support bar 63 and bench press bar means 35 to accommodate individual user height requirements, and also provides for exercising different parts of the body. For example, by positioning support bar 63 in a lower pair of U-shaped brackets 65, thereby orienting bench press bar means 35 in a downwardly inclined position (not shown), a user is required to bend and raise the bench press bar (via hand grips 59) to substantially chest level position, requiring the use of arm, leg, chest and back muscles. By positioning support bar 63 to orient bench press bar means 36 in an upwardly inclined position, arm and chest muscles are primarily exercised.

Weight system 37 is positioned in the rear area of compartment C to provide the desired weight lifting tension for operation of bench press bar 35 and pull down bar 90, discussed below, as well as other exercises requiring weight lifting tension. As best shown in FIG. 1, weight system 37 includes a plurality of rectangular weight units 37*a* resting on bottom panel 12*c*. Weight units 37*a* are mounted on cable attachment rod 41 connected to cable means 40, as discussed, infra. Attachment rod 41 includes a plurality of holes 41*a*, shown only in FIG. 2, located transversely to the longitudinal axis of the attachment rod. Insertion of a pin (not shown) extending through holes (not shown) located in weights 37*a* aligned with holes 41*a* allows a user to select a desired combination of weights located upwardly from the retaining pin. The pair of vertical guide tracks 41*b*, secured within the rear portion of compartment C, extend through each weight unit 37*a* and serve to define a vertical guide path for the weights during lifting movement. weight system 37 is shown for illustrative purposes only. It will be understood that other configurations providing rigid guides for weight lifting movement, which further enable quick and easy weight selection, can also be used in accordance with the present invention.

Upper and lower pulleys 43*a*, 43*b* are provided in cabinet C for operation of bench press bar 35. As shown in FIGS. 1 and 2, pulleys 43*a*, 43*b* are respectively attached to the inner surface of top panel 12*c* and cross bar 18 in vertical alignment with weights 37*a*. Cable 40, such as high strength synthetic cord, is secured to attachment rod 41 and trained around pulleys 43*a*, *b* and pulley 32 for attachment to chain 40' (shown only in FIG. 2) and connection with cross rod 58 (shown in dotted line position in FIG. 2). This design allows vertical pivoting movement of bench press bar 35 by the user for raising and lowering weights 37*a*. Smooth sliding movement between cable 40 and the pulley arrangement allows for performance of various bench press exercises, as discussed above. Chain 40' is releasably attachable to cable 40 and cross rod 58 with quick release snaps or pins, and also serves to connect weights 37*a* to pull down bar 90, discussed infra. Chain 40' allows for quick and easy adjustment to different exercising positions, and to accommodate individual user height requirements.

Dip bar means is provided for performing dips and other arm exercises. As shown in FIG. 1, such means preferably includes a pair of structurally rigid upper and lower support arms 70, 72 pivotally attached to each of second support legs 16 to allow horizontal positioning of upper support arms 70 in set-up position. Due to the spacing between second support legs 16, a user is able to stand between the second support legs and grasp support arms 70 for exercising movement.

The pivotal joints connecting support arms 70, 72 to second support legs 16 are preferably pin type joints. Support arms 72 are fabricated of high strength material, such as wood or aluminum. Support arms 70 are preferably fabricated of high strength channel stock which gives several important advantages. In addition to improved structural strength, downwardly directed positioning of the channel serves to provide an upper, flat horizontal surface for comfortable and proper gripping of support arms 70. Further, transverse attachment of a stop member 71 within the distal ends of the channel advantageously allows for abutment between the upper, distal end of lower support arm 72 and the stop member, thereby retaining upper support arm 70 in horizontal set-up position. Easy disengagement between stop member 71 and lower support arm 72 allows the support arms to pivot downwardly into fold-up position adjacent the second support legs (see dotted line position of FIG. 2).

Upwardly directed chin bar assembly 75 is capable of pivoting into fixed, overhead position for chinning exercises. as shown in FIG. 1, chin bar assembly 75 includes a transverse chinning bar 77 having opposite ends attached to corresponding distal ends of a pair of parallel connecting rods 79. The opposite, proximal ends of connecting rods 79 include holes for allowing sleeve member 22 to pass therethrough for pivotal movement about pivot shaft 20 (FIG. 3). Connecting rods 79 are mounted outwardly adjacent second support legs 16 on sleeve 22. Stop bar 84, discussed below, interconnects connecting rods 79 to maintain the same in spaced, parallel relation to each other for stable, reliable pivoting movement.

As mentioned above, connecting rods 79 are spaced outwardly from second support legs 16. Such spacing advantageously allows chinning bar 77 to pivot downwardly into flush position on first support legs in substantially flat, fold-up position, as discussed infra. In set-up position, connecting rods 79 can be dimensioned for retention in receiving location 47' in the event use of chin bar assembly 75 is not desired. In this manner, chin bar assembly 75 is capable of assuming an intermediate fold-up position by pivoting downwardly into receiving location 47' (not shown in detail) to enable unrestricted operation of the dip bar or bench press bar 35, discussed above; thereafter, the chin bar can be easily pivoted into overhead position for use.

Figure 5:
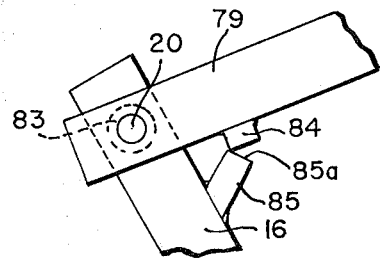
FIG. 5 is a partial, detailed view of the stop members provided for locating the chain bar assembly in fixed, overhead position above the second support legs.

To maintain chin bar assembly 75 in fixed, overhead position, a pair of block-shaped stop members 85 are attached to upper portions of second support legs 16. Each stop member 85 projects outwardly from the second support legs and includes an upwardly directed abutment face 85*a* capable of abutting engagement with stop bar 84. Stop bar 84 extends transversely between connecting rods 79, and is attached to the forward, lower edge of the connecting rods. Stop bar 84 is capable of synchronous upward pivoting movement with connecting rods 79 for abutting engagement with upwardly directed abutment faces 85*a*, as shown in FIG. 5.

Chin bar assembly 75 advantageously allows for suspension of pull-down bar 90. As best shown in FIG. 1, pull-down bar 90 is fabricated of round stock, using suitably rigid materials providing smooth gripping engagement, and is suspended from chinning bar 77 by means of cable 92. Cable 92 is trained around pulley 94 attached to the center section of chinning bar 77 and interconnects pull-down bar 90 to weight system 37 by means of chain 40' (FIG. 2) discussed supra. In this manner, pull-down bar 90 is grasped by the user to raise and lower weights 37*a* in exercising movement.

In the preferred embodiment, pull down bar 90 and support bar 63 are identical structures; provision of quick release snap 91 at the mid-point of the bar allows for attachment of cable 92 thereto when the bar is used as a pull down bar. Additionally, the bar can be used for curling exercises when cable 92 is disengaged from pulley 94. Other exercises are also possible with this design.

As shown in FIGS. 1 and 2, bench assembly 100 is provided for pivotal attachment to second support legs 16 and includes a substantially planar, rectangular bench section 102 fabricated of lightweight material. Bench 102 is supported with a steel frame (not shown in detail) attached to the bottom surface of the bench and includes a pair of legs 104 pivotally connected to the frame at the forward end of the bench to enable horizontal positioning of the bench on second support legs 16 (FIG. 1). Support struts 106, pivotally secured to the lower portion of legs 104, slidably engage the frame structure until fully extended into inclined, locked position, and serve to support the legs in set-up position. The opposite end of bench 102 includes support bar 108 transversely attached to the bench. Support bar 108 includes opposite ends extending outwardly from the sides of bench 102 for positioning within a corresponding pair of U-shaped brackets 65 to support the bench on the second support legs.

Bench assembly 100 provides several important advantages to collapsible gym apparatus 10. For example, in horizontal position, bench 102 is operable to support a user within arm's reach below bench press bar 35, enabling the user to raise and lower the bench press bar, as discussed above, by grasping hand grips 59. Further, bench assembly 100 can be used in a downwardly inclined position as a sit-up board by folding legs 104 into substantially flat position beneath the bench. In this position, bench 102 is supported on second support legs 16 by support bar 108, as described above.

In a different construction of bench 100, the frame structure supporting bench 102 is extensible and can be fully extended to allow flush positioning of the user's body on the bench which is particularly advantageous during performance of sit-up exercises.

The operation of and unique features provided by collapsible gym apparatus 10 is best understood by outlining the movement of the first and second pairs of support legs 14, 16, and exercising attachment means, between set-up and fold-up positions. In set-up position, shown in FIG. 1, it will be appreciated that numerous exercises are possible with the exercising attachment means provided on first and second sets of support legs 14, 16. For example, bench 100 enables a user to perform both inclined bench sit-ups (FIG. 2) and level bench sit-ups (FIG. 1). Bench 100, in combination with bench press bar 35, enables a user to perform forward leg lifts, curls, leg exercises and other bench press exercises. Easy removal of bench 100 allows the user to operate bench press bar 35 and other accessories to perform curls and other exercises, as discussed above. Removal of support bar 63 allows bench press bar 35 to pivot about joint B into an intermediate position (not shown) between first and second sets of support legs 14, 16 to allow the user to engage horizontal support arm 70 and perform dip exercises between the second support legs. In addition, the dip bars can be used in conjunction with bench 100, when the bench is positioned flush on second support legs 16 in storage position, for doing front leg lifts. In set-up position, chin bar assembly 75 is operable to provide for chinning exercises. Pull down bar 90 can be used in connection with the pulley/cable arrangement to raise and lower weights 37.

In addition to allowing user performance of a variety of exercises, discussed above, an important advantage provided by the present invention is the ability of collapsible gym apparatus 10 to fold up into storage position in cabinet 12 in a fast and easy manner. As shown in FIG. 2, storage of collapsible gym apparatus 10 is achieved by pivoting chin bar assembly 75 downwardly, in the direction of arrow E towards the cabinet, for retention in receiving location 47'. Removal of support bar 63 enables bench press bar 35 to pivot about joints A and B into overlapping, flush position (see dotted line position in FIG. 2). Such fold-up movement of bench press bar 35 serves to position and retain chin bar assembly 75 flush behind the bench press bar (not shown in detail). Bench 100 is capable of pivoting upwardly around support bar 108 into flush position on second support leg 16 (see dotted line position in FIG. 3). Removal of the lower ends of second support legs 16 from the holes formed in mounting tracks 25 allows pivoting movement of the first and second sets of support legs about support shaft 18 into substantially flat fold-up position in compartment C.

As shown in FIG. 4, the unique structure provided by collapsible gym apparatus 10 allows the first and second sets of support legs 14, 16 and exercising attachment means to occupy the forward portion of compartment C; the rear compartment portion is occupied by weight system 37, pulley 43*a*, and portions of cable 40 interconnecting the pulley and weights. With this design, collapsible gym apparatus 10 can be stored in substantially flat position against a wall in the home or office, as described above, and thereafter be set up into position upon floor F or the like when desired by the user.

While there has been described and illustrated the preferred embodiment of the invention, it will be clear that variations in the details of the embodiment specifically illustrated and described may be made without departing from the true spirit and scope of the invention as defined in the appended claims.

I claim:

1. A collapsible gym apparatus, comprising:

(a) first and second pairs of legs pivotally connected at upper portions for selective movement between a stored foldup position and a stationary and fixed set-up position, said first and second pairs of legs forming an A-frame structure for supporting a user in the performance in body exercises;

(b) exercising attachment means pivotally connected to at least one of the first and second pairs of legs for selective movement between a stored foldup position on said legs and a set-up position supported by the legs for performing body exercises, said exercising attachment means and first and second sets of legs capable of assuming a substantially flat, fold-up position for storage convenience; and (c) means for pivotally interconnecting said upper portions together, said upper connecting means including a pivot shaft passing through both the first and second pairs of legs, thereby enabling the first and second pairs to pivot with respect to each other between set-up and foldup position on said pivot shaft, wherein said second pair of legs is connected to the pivot shaft between the first pair of legs for selective forward pivotal movement outwardly from the first pair of legs and return to substantially flat foldup position between the first pair of legs, said pivot shaft being the sole upper interconnecting structure of said legs.

2. A collapsible gym apparatus according to claim 1, said second pair of legs pivotally secured to the pivot shaft with a sleeve member concentrically mounted on the pivot shaft.

3. A collapsible gym apparatus according to claim 2, wherein said exercising attachment means includes bench press bar means having rod members pivotally secured at one end to the first pair of legs for forward pivoting movement from a fold-up position on the first and second pairs of support legs into set-up position supported by the second pair of legs, and a pair of hand grips connected to the bench press bar means, said hand grips extending outwardly from said second pair of legs in set-up position enabling a user to engage the hand grips for raising and lowering a load connected to said bench press bar means.

4. A collapsible gym apparatus according to claim 3, wherein said bench press bar means further includes first and second sections pivotally secured together, said first section pivotally secured to the first pair of legs, and support means for supporting the second section carrying the hand grips on the second pair of legs in set-up position.

5. A collapsible gym apparatus according to claim 4, wherein said second section includes a cross brace member engaging the first section in set-up position to maintain said first and second sections in rigid, coplanar relation to each other.

6. A collapsible gym apparatus according to claim 3 or 4, wherein said exercising attachment means further includes dip bar means having a pair of upper and lower arms pivotally secured to each of said second pair of legs for substantial horizontal positioning of the upper arm in each pair supported by the lower arms, said upper and lower arms being foldable to storage position substantially flush on the second set of legs.

7. A collapsible gym apparatus according to claim 6, wherein said upper arms are fabricated from channel stock for receiving the lower arms in abutting engagement with stop members provided in the channel in set-up position.

8. A collapsible gym apparatus according to claim 6, wherein said exercising attachment means further includes chin bar means having a pair of connecting rods with corresponding ends pivotally secured to the sleeve member, and a transverse chin bar extending between the distal ends of the connecting rods, said chin bar means being pivotable to an overhead position outwardly from the first pair of legs for enabling a user to perform chinup exercises, and stop means for maintaining said chin bar means at a predetermined overhead set-up position.

9. A collapsible gym apparatus according to claim 8, wherein said stop means includes a pair of block shaped members projecting forwardly from the second pair of legs, and a transverse bar attached to the connecting rods, said transverse bar capable of upward pivoting movement with the chin bar means into abutting engagement with the block members to maintain the transverse bar in fixed overhead position.

10. A collapsible gym apparatus according to claim 9, said connecting rods spaced apart from each other on the pivot shaft between the first and second pairs of legs, thereby enabling the transverse bar to contact said first pair of legs when pivoted downwardly into storage position flush on said first legs.

11. A collapsible gym apparatus according to claim 1 or 10, further comprising a cabinet housing for storing said first and second pairs of legs, exercising attachment means and anchoring means in substantially vertical, fold-up position within said cabinet, said first pair of legs having lower ends pivotally secured to side body members of the cabinet housing.

12. A collapsible gym apparatus according to claim 11, wherein said anchoring means includes a door member hingedly secured to the cabinet for flush positioning on a floor, and a pair of substantially parallel mounting tracks attached to the door member, said tracks spaced apart from each other and including means for receiving lower ends of the second pair of legs in set-up position.

13. A collapsible gym apparatus according to claim 12, wherein said lower receiving means includes a plurality of holes formed in the track to receive lower ends of the second legs, enabling adjustment of the spacing between said first and second leg pairs.

14. A collapsible gym apparatus according to claim 4, further comprising pairs of upwardly directed U-shaped mounting brackets attached in corresponding location to the second pair of legs.

15. A collapsible gym apparatus according to claim 14, wherein said support means includes a transversely extending support bar carried in the brackets, said support bar dimensioned to project outwardly from the second pair of legs to support the second section of the bench press bar means in set-up position, said support bar capable of disengagement from the brackets for other exercising uses.

16. A collapsible gym apparatus according to claim 15, further comprising bench assembly means releasably attachable to said second pair of legs for supporting a user during performance of body exercises.

17. A collapsible gym apparatus according to claim 16, wherein said bench assembly means further includes support leg means pivotally attached to an end of said bench assembly means located outwardly from the second pair of legs in set-up position for supporting said bench assembly means in substantially horizontal position.

18. A collapsible gym apparatus according to claim 17, wherein said bench assembly means further includes a cross member dimensioned to engage a pair of said upwardly directed U-shaped brackets for supporting the bench assembly means on the second pair of legs, said cross member enabling upward pivoting of the bench assembly means to a storage position flush on the second pair of legs.

19. A collapsible gym apparatus according to claim 18, further comprising pulley and cable means interconnecting the bench press bar means to weight means positioned in the cabinet, said weight means enabling weight pulling exercises with the bench press bar means.

20. A collapsible gym apparatus according to claim 19, wherein said pulley and cable means is further interconnected to an elongated pull-down bar depending from the transverse chin bar, enabling weight pulling exercises with the pull-down bar.

21. A collapsible gym apparatus according to claim 20, wherein said pulley means further includes a pulley connected to the transverse chin bar for supporting the pull down bar depending from said transverse chin bar.

22. A collapsible gym apparatus according to claim 19, wherein said pulley means includes upper and lower pulleys positioned in the cabinet housing, a pulley positioned on the guide rail means below the bench press bar means in set-up position, said cable means connected to the weight means and trained around the pulleys for connection to the bench press bar means and other accessories.

23. A collapsible gym apparatus according to claim 19 or 20, wherein said cable means further includes chain means for connecting the weight means to the bench press bar means or the like, said chain means allowing for adjustment of the cable means to accommodate individual user heights and provide for additional exercises.

24. A collapsible gym apparatus according to claim 14, wherein said first section includes an inwardly facing recessed portion for retaining said chin bar means in an intermediate storage position.

* * * * *